US007052404B2

(12) United States Patent
Heddon

(10) Patent No.: US 7,052,404 B2
(45) Date of Patent: May 30, 2006

(54) RAIL POSITIONING DEVICE FOR RETRACTABLE BUMPER ASSEMBLY

(76) Inventor: Will Heddon, 302 E. Central Ave., Lake Wales, FL (US) 33853

( * ) Notice: Subject to any disclaimer, the term of this patent is extended or adjusted under 35 U.S.C. 154(b) by 0 days.

(21) Appl. No.: 10/688,523

(22) Filed: Oct. 17, 2003

(65) Prior Publication Data

US 2005/0085308 A1 Apr. 21, 2005

(51) Int. Cl.
*A63D 5/00* (2006.01)

(52) U.S. Cl. ..... 473/113; 473/55

(58) Field of Classification Search ..... 473/54, 473/55, 106, 113, 115
See application file for complete search history.

(56) References Cited

U.S. PATENT DOCUMENTS 5,322,476 A * 6/1994 Wortman ..... 473/113
5,681,224 A * 10/1997 Higashi ..... 473/109
6,270,136 B1 * 8/2001 Dagenais ..... 294/88
6,318,424 B1 * 11/2001 Elfrink ..... 144/195.1

* cited by examiner

*Primary Examiner*—William M. Pierce
(74) *Attorney, Agent, or Firm*—Arthur W. Fisher, III

(57) ABSTRACT

A rail positioning device for use with a retractable bumper assembly that includes an elongated rail movable between a retracted position and an elevated position supported by a plurality of rail support members to prevent bowling balls from entering a bowling lane gutter adjacent the retractable bump assembly when the elongated rail is in the elevated position wherein the rail positioning device comprises a rail positioning assembly disposed in operational relationship relative to a rail positioning actuator each movable between a retracted position and an extended position such that when the rail positioning assembly is moved from the retracted to the extended position by the rail positioning actuator moving from the retracted position to the extended position the rail positioning assembly engages the elongated rail to move the elongated rail from the retracted position to the elevated position to prevent a bowling balls from entering the adjacent gutter.

5 Claims, 6 Drawing Sheets

RAIL POSITIONING DEVICE FOR RETRACTABLE BUMPER ASSEMBLY

BACKGROUND OF THE INVENTION

1. Field of the Invention

A rail positioning device for use with a retractable bumper assembly to prevent bowling balls from entering a gutter adjacent the retractable bumper assembly.

2. Description of the Prior Art

A poorly thrown bowling ball can fall into either gutter. For various reasons bumper systems have been developed that prevent a bowling ball from entering the gutters. Generally, an elongated guard or rail is placed along the length of each gutter to prevent a bowling ball from entering the corresponding gutter.

Numerous retractable bumper systems have been developed which permit the elongated guards or rails to be easily deployed or retracted. There are several problems associated with these various systems including:

- The attaching means at the pivot connection between the rail and the support members normally consist of a mechanical fastener that is exposed to view.
- The pivots are rigidly mechanically attached to the rail making the pivots vulnerable to ball impact, which in turn causes damage to the pivots.
- Some rail materials expand and contract with moisture and/or temperature changes. This causes undo stress on the rails and pivot arms.
- Assembly is required on all the known rail pivot combinations prior to packaging and shipping which adds to the cost of shipping, labor and overhead.
- Exposed fasteners sometimes come loose and cause ball damage.
- Excessive ball speed impact damages rails and pivot arms that must be replaced prior additional use. Replacement is time consuming and expensive and normally involves both the rail and multiple pivot arms.

U.S. Pat. No. 6,402,629 describes a bumper system to prevent a bowling ball from entering the gutters, redirecting the ball into the lane comprising a longitudinal rail with a plurality of pivot arms affixed thereto. The pivot arms are pivotally affixed to the lane bed such that when the bumper system is in a retracted position the horizontal surface of the longitudinal rails are in a substantially abutting relation to the side of the lane, and the adjacent gutters are adapted to receive any balls that are bowled towards either side of the lane, directing the balls to the end of the lane, missing the pin deck. In an extended position, the longitudinal rails prevent balls from entering the adjacent gutters redirecting balls into the lane such that the balls strike the pins in the pin deck.

U.S. Pat. No. 5,380,251 discloses a bowling alley bumper system to selectively guard against a bowling ball rolling into a gutter comprising a bungee cord extends along each side edge of a bowling alley lane. When the bungee cord is and in a first position below the lane surface bowling balls can roll into a gutter. A lifting mechanism can raise the bungee cord to a position above the lane surface for receiving bowling balls rolling on the surface toward the gutter and redirecting the bowling balls toward the center of the lane and away from the gutter. The bungee cord is lifted to its second position by a plurality of elongated rods positioned to move alongside the lane below the gutter surface. A connecting rod raises and lowers the elongated rods through a lever action thereby positioning the bungee cord at its first stored position or its elevated position for guarding the gutter.

Additional examples of such retractable bumper systems have been described in: U.S. Pat. No. 4,420,155; U.S. Pat. No. 4,792,136; U.S. Pat. No. 4,900,024; U.S. Pat. No. 5,181,716; U.S. Pat. No. 5,207,422; U.S. Pat. No. 5,304,097; U.S. Pat. No. 5,322,476; U.S. Pat. No. 5,358,448; U.S. Pat. No. 45,405,295; U.S. Pat. No. 5,415,591; U.S. Pat. No. 5,417,616; U.S. Pat. No. 5,435,788; U.S. Pat. No. RE. 35,232; U.S. Pat. No. 5,564,986; U.S. Pat. No. 5,681,224; U.S. Pat. No. 5,800,274 and U.S. Pat. No. 5,857,918.

SUMMARY OF THE INVENTION

The present invention relates to a rail positioning device to selectively position a retractable bumper assembly to prevent a bowling ball from the bowling lane gutter adjacent thereto. The retractable bumper assembly comprises an elongated rail movable between a retracted position and an elevated position supported by a plurality of rail support members.

The rail positioning device comprises a rail positioning assembly and a rail positioning actuator. The rail positioning assembly includes a rail positioning member longitudinally movable between a retracted position and an extended position and a rail positioning element rotatably movable between a retracted position and an extended position disposed to engage the elongated rail. The rail positioning actuator includes an actuator element longitudinally movable between a retracted and an extended position to selectively move the rail positioning member from the retractable and the extended position which, in turn, moves the rail positioning element from the retracted position and the extended position as the actuator element moves from the retracted position to the extended position to move the elongated rail from the retracted position to the elevated position to prevent a bowling ball from entering the adjacent gutter.

The actuator element can be displaced or moved between the retracted position and the extended position by a mechanical, electrical, hydraulic or pneumatic displacement system, and will be readily apparent to the skilled artisan.

The invention accordingly comprises the features of construction, combination of elements, and arrangement of parts that will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
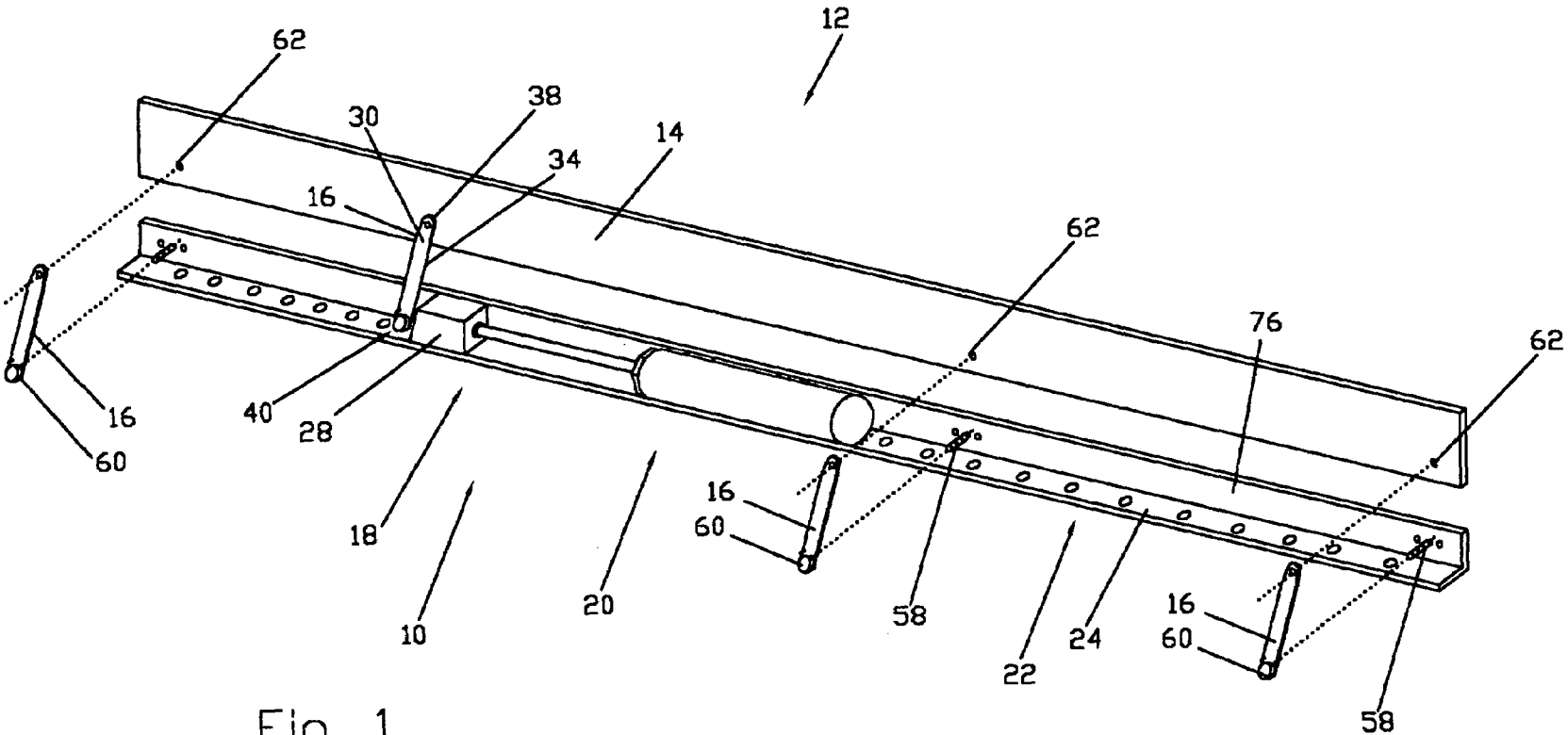
FIG. 1 is a perspective view of the rail positioning device of the present invention in the extended position.
Figure 2:
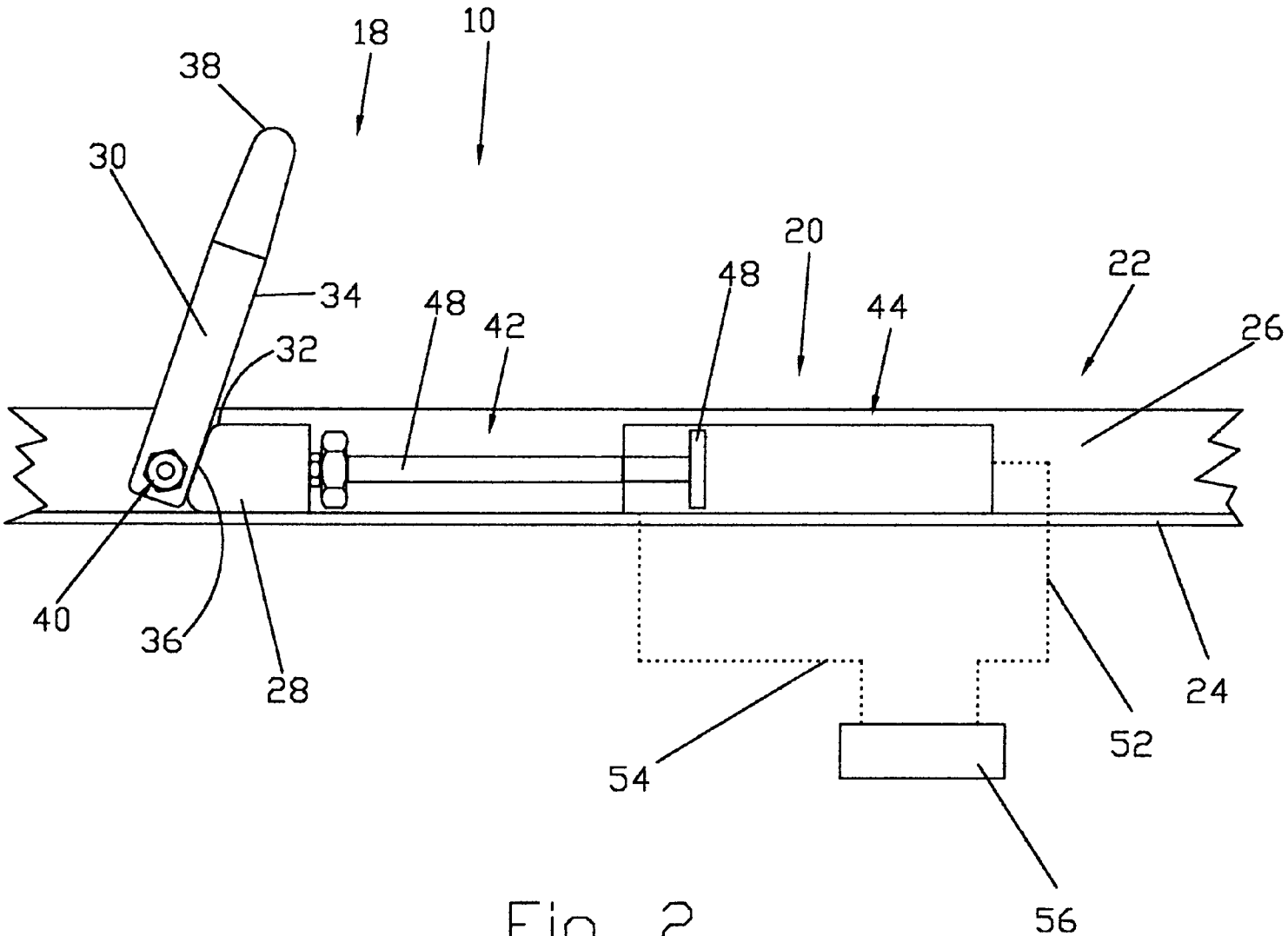
FIG. 2 is a side view of the rail positioning device of the present invention in the extended position.

As shown in FIGS. 1 through 5, the present invention relates to a rail positioning device generally indicated as 10 for use with a retractable bumper assembly generally indicated as 12 that includes an elongated rail 14 movable between a retracted position and an elevated position supported by a plurality of rail support members each indicated as 16 (FIG. 1) to prevent bowling balls from entering a bowling lane gutter (not shown) adjacent the retractable bumper assembly 12 when the elongated rail 14 is in the elevated position.

The rail positioning device 10 comprises a rail positioning assembly generally indicated as 18 and a rail positioning actuator generally indicated as 20 mounted on or coupled to a rail support generally indicated as 22 such as an L-shape member including a substantially horizontal element or leg 24 and a substantially vertical element or leg 26 to secure the rail positioning device 10 and the retractable bumper assembly 12 adjacent the bowling lane gutter (not shown) by a plurality of fasteners 27.

Figure 3:
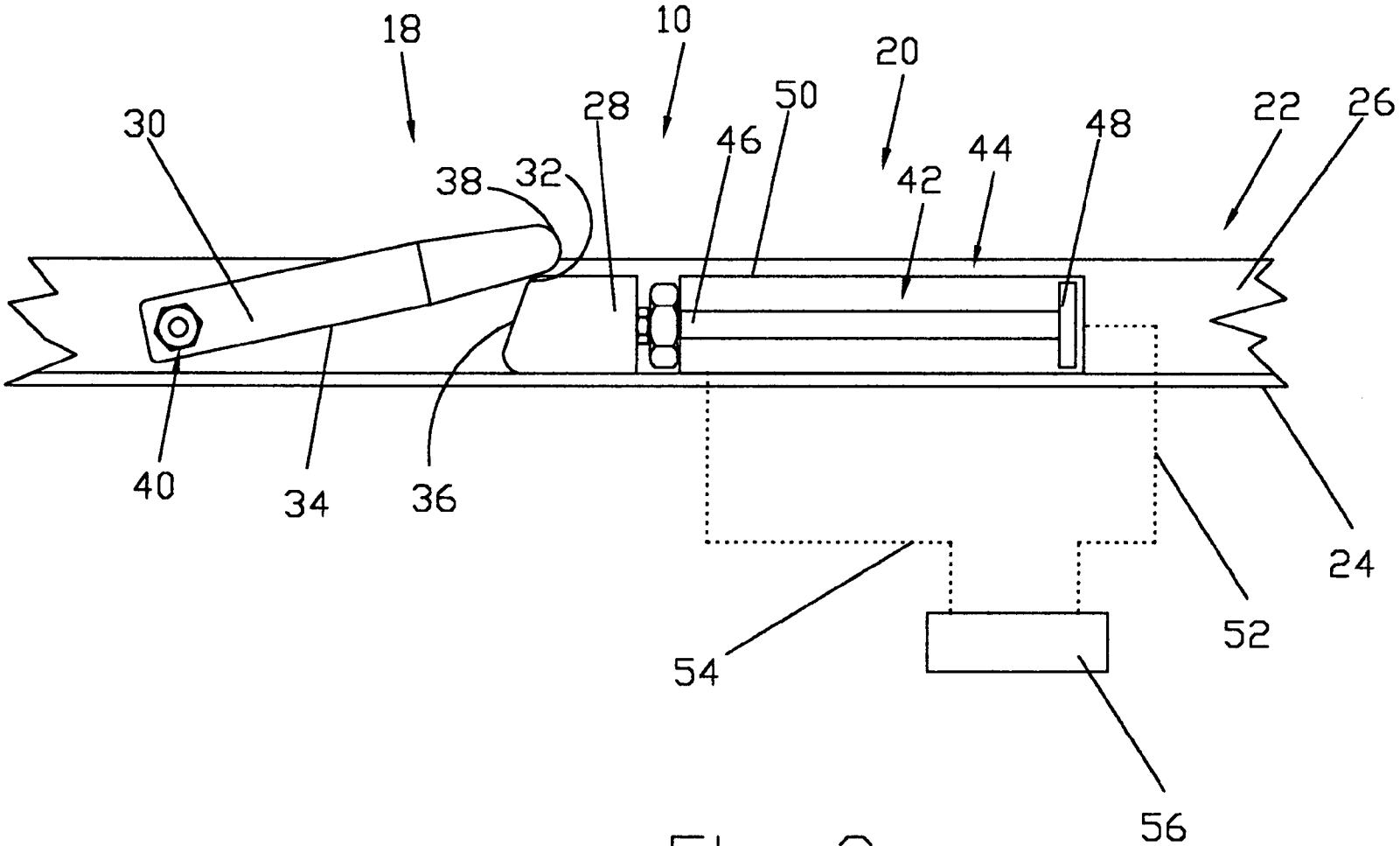
FIG. 3 is a side view of the rail positioning device of the present invention in the retracted position.
Figure 4:
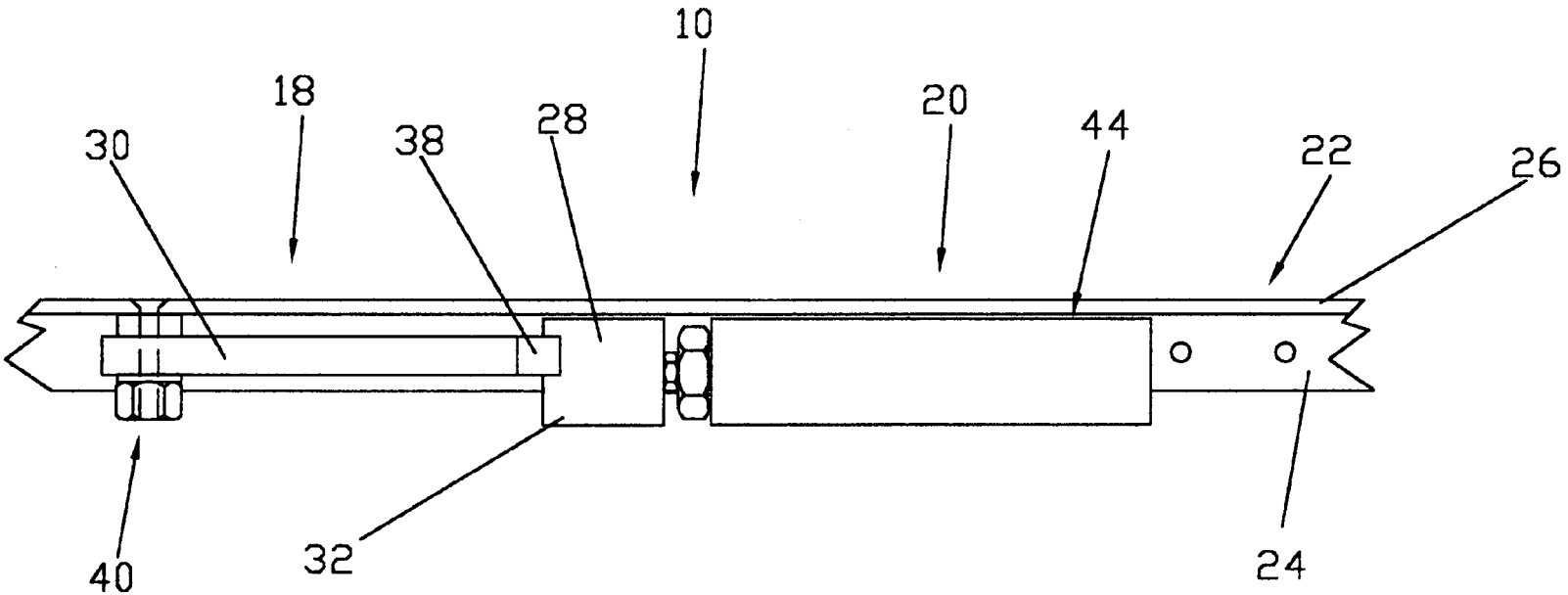
FIG. 4 is a top view of the rail positioning device of the present invention in the retracted position.
Figure 5:
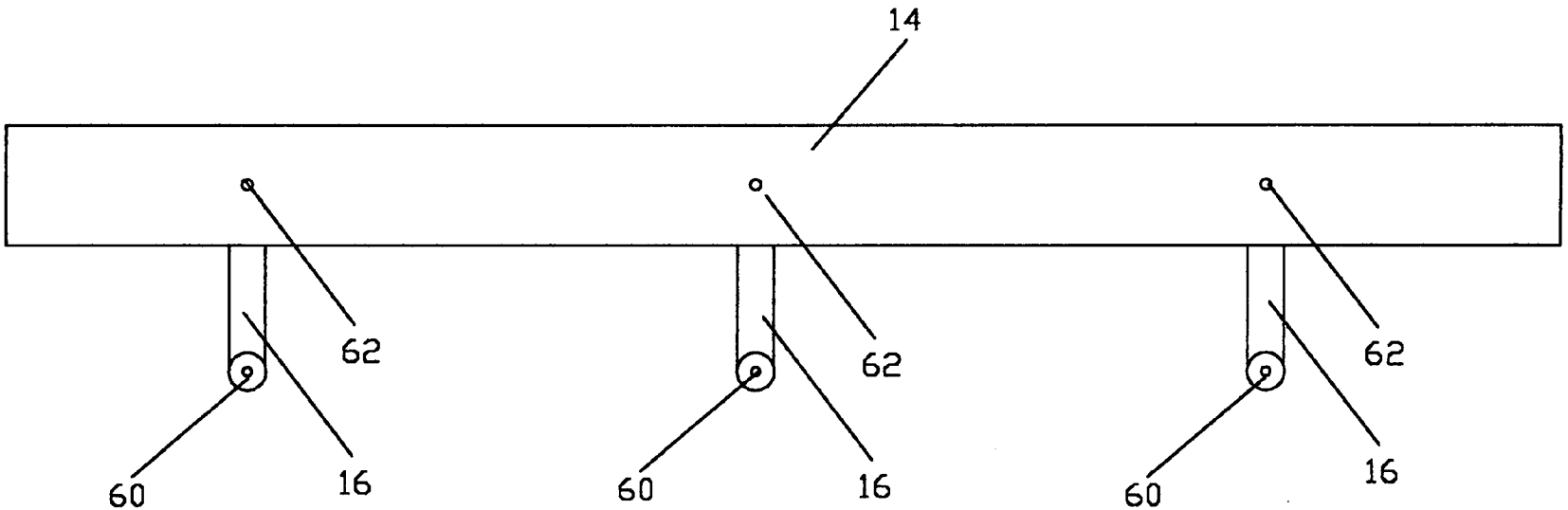
FIG. 5 is a detailed end view of the rail positioning device of the present invention in the extended position.
Figure 6:
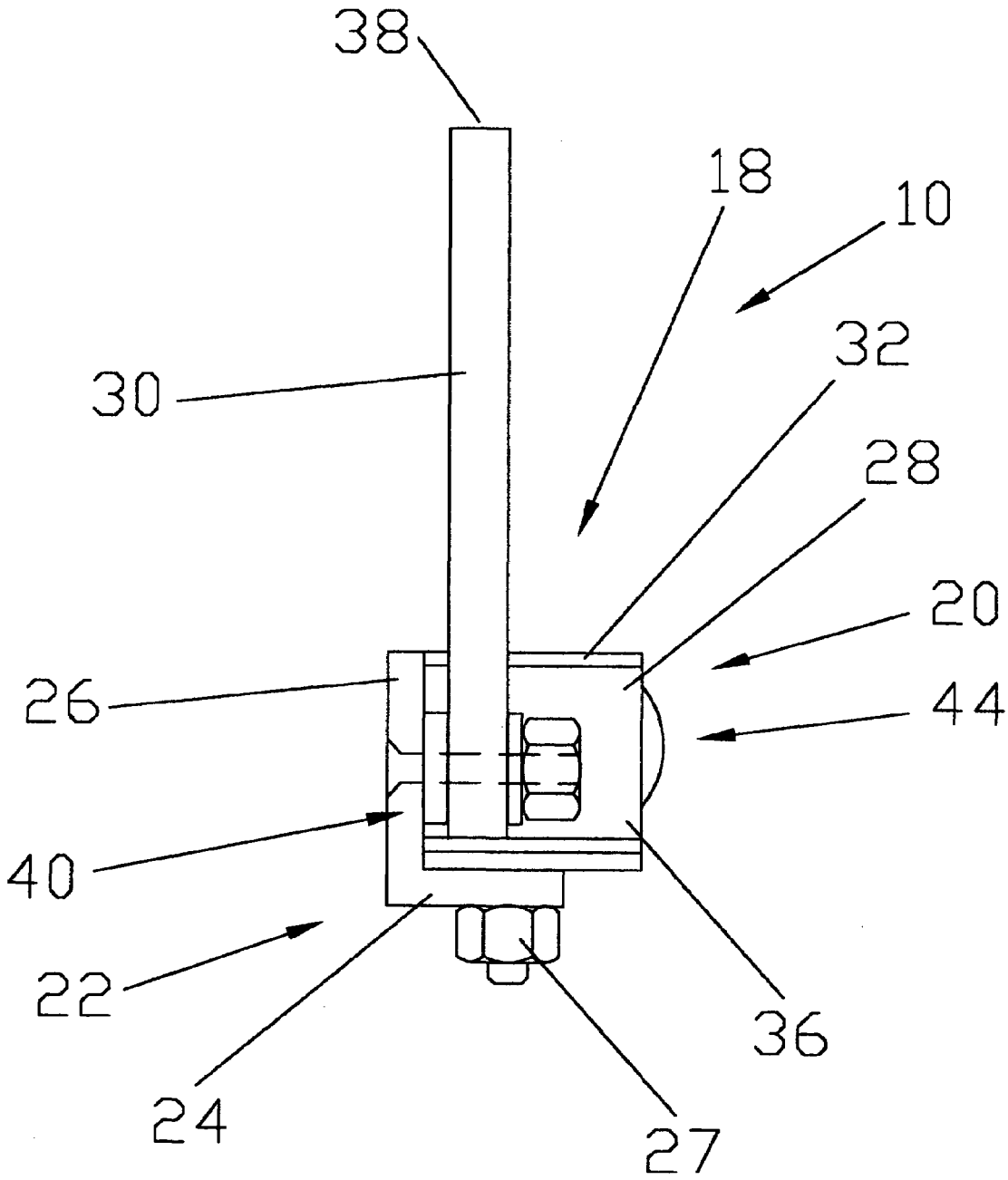

The rail positioning assembly 18 comprises a rail positioning member 28 longitudinally movable between an extended position (FIG. 2) and a retracted position (FIG. 3) and a rail positioning element 30 rotatably movable between an extended position (FIG. 2) and a retracted position (FIG. 3). The rail positioning member 28 includes an arcuate or convex camming surface 32 disposed to engage the side surface 34 of the rail positioning element 30 and an inclined substantially flat surface 36 disposed to engage the side surface 34 of the rail positioning element 30 when the rail positioning member 28 and the rail positioning element 30 are each in the extended position to maintain the elongated rail 14 in the elevated position. The lower surface of the rail positioning member 28 slidingly engages the substantially horizontal element or leg 24 of the rail support 22 during operation of the rail positioning device 10. The rail positioning element 30 includes an upper arcuate or convex camming surface 38 to engage the elongated rail 14 of the retractable bumper assembly 12. The rail positioning element 30 is rotatably coupled to the substantially vertical element or leg 26 of the rail support 22 by a fastener generally indicated as 40.

The rail positioning actuator 20 comprises an actuator element generally indicated as 42 longitudinally movable between an extended position (FIG. 2) and a retracted position (FIG. 3) and an actuator element positioning device generally indicated as 44 to move the actuator element 42 between the extended position and the retracted position.

The rail positioning actuator 20 can be displaced or moved between the retracted position and the extended position by a mechanical, electrical, hydraulic or pneumatic displacement system, and will be readily apparent to the skilled artisan. For example, the actuator element 42 may include an elongated shaft 46 having one end portion thereof coupled to the rail positioning member 28 of the rail positioning assembly 18 and an actuator member or piston 48 coupled to the opposite end portion thereof; while, the actuator element positioning device 44 may comprise a hydraulic or pneumatic cylinder 50 coupled to a fluid pressure source.

Operation of the actuator element positioning device 44 involves the selective introduction of high pressure air or hydraulic fluid into the hydraulic or pneumatic cylinder 50 pushing against the actuator member or piston 48 to extend or retract the elongated shaft or connecting rod 46 extending or retracting the rail positioning member 28. Pressurized air or hydraulic fluid is circulated through the hydraulic or pneumatic cylinder 50 by a supply conduit 52 and a return conduit 54 in operative communication with a hydraulic pump or pressurized air supply 56. The hydraulic pump or pressurized air supply 56 may be powered by en electric motor. Electromechanical valves (not shown) common in the art are disposed between the supply conduit 52 and the return conduit 54 and the hydraulic pump or pressurized air supply 56 to control the flow of air or hydraulic fluid to and from the hydraulic or pneumatic cylinder 50.

The effective length of the elongated shaft or connecting rod 46 can be adjusted by an adjustment device generally indicated as 58 such as a nut threadably mounted on an externally threaded portion of the elongated shaft 46.

As shown in FIG. 1, each rail support member 16 is pivotally coupled to the substantially vertical element or leg 26 of the rail support 22 by a corresponding pin 59 or the like extending through a corresponding aperture 60; while, the opposite end portion of each rail support member 16 is rotatably coupled to the elongated rail 14 by corresponding pins or members 62.

In operation, the rail positioning member 28 is moved from the retractable and the extended position by the actuator element 42 moving longitudinally from the retracted position to the extended position to rotate the rail positioning element 30 from the retractable and extended position to move the elongated rail 14 from the retracted position to the elevated position to prevent a bowling ball from entering the adjacent gutter (not shown).

The process is reversed to return the elongated rail 14 to the retracted position. Since the rail positioning element 30 is supported by the rail positioning member 28 inclined at an angle of less than 90 degrees (90°), the rail positioning element 30 rotates downwards under the force of gravity as the rail positioning member 28 is retracted by the actuator element 42.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described.

What is claimed is:

1. A rail positioning device for use with a retractable bumper assembly that includes an elongated rail movable between a retracted position and an elevated position supported by a plurality of rail support members to prevent bowling balls from entering a bowling lane gutter adjacent said retractable bump assembly when the elongated rail is in said elevated position, said rail positioning device comprises a rail positioning assembly disposed in operational relationship relative to a rail positioning actuator, said rail positioning assembly and said rail positioning actuator each movable between a retracted position and an extended position such that when said rail positioning assembly is moved from said retracted to said extended position by said rail positioning actuator moving from said retracted position to said extended position said rail positioning assembly engages said elongated rail to move said elongated rail from said retracted position to said elevated position to prevent a bowling balls from entering said adjacent gutter, said rail positioning assembly comprises a rail positioning member longitudinally movable between a retracted position and an extended position and a rail positioning element including a substantially flat side surface rotatably movable between a retracted position and an extended position disposed to engage the elongated rail, said rail positioning actuator comprises an actuator element longitudinally movable between a retracted and an extended position to move said rail positioning member from said retractable and said extended position to move said rail positioning element from said retracted position and said extended position as said actuator element moves from said retracted position to said extended position to move the elongated rail from said retracted position to said elevated position, said rail positioning member includes an arcuate camming surface disposed to initially engage said substantially flat side surface of said rail positioning element to selectively rotate said rail positioning member from said retracted position to said extended position and an inclined surface disposed to engage said substantially flat side surface of said rail positioning element when said rail positioning member and said rail positioning element are each in said extended position to maintain said elongated rail in said elevated position.

2. A retractable bumper assembly comprising an elongated rail movable between a retracted position and an elevated position supported by a plurality of rail support members to prevent bowling balls from entering a bowling lane gutter adjacent said retractable bump assembly when said elongated rail is in said elevated position and a rail positioning device comprising a rail positioning assembly disposed in operational relationship relative to a rail positioning actuator, said rail positioning assembly and said rail positioning actuator each movable between a retracted position and an extended position such that when said rail positioning assembly is moved from said retracted to said extended position by said rail positioning actuator moving from said retracted position to said extended position said rail positioning assembly engages said elongated rail to move said elongated rail from said retracted position to said elevated position to prevent a bowling balls from entering said adjacent gutter, said rail positioning assembly comprises a rail positioning member longitudinally movable between a retracted position and an extended position and a rail positioning element including a substantially flat side surface rotatably movable between a retracted position and an extended position disposed to engage said elongated rail, said rail positioning actuator comprises an actuator element longitudinally movable between a retracted and an extended position to move said rail positioning member from said retractable and said extended position to move said rail positioning element from said retracted position and said extended position as said actuator element moves from said retracted position to said extended position to move said elongated rail from said retracted position to said elevated position, said rail positioning member includes an arcuate camming surface disposed to engage said substantially flat side surface of said rail positioning element to selectively rotate said rail positioning member from said retracted position to said extended position and an inclined surface disposed to engage said substantially flat side surface of said rail positioning element when said rail positioning member and said rail positioning element are each in said extended position to maintain said elongated rail in said elevated position.

3. The rail positioning device of claim 1 wherein said rail positioning element includes a camming surface to engage the elongated rail.

4. The rail positioning device of claim 1 wherein said rail positioning actuator further includes an actuator element positioning device to move said actuator element between the retracted position and the extended position.

5. The rail positioning device of claim 4 wherein said actuator element comprises an elongated shaft having one end portion coupled to said rail positioning member and an actuator piston coupled to the opposite end portion thereof and said actuator element positioning device comprises a pressurized fluid cylinder.

* * * * *